US008047401B2

(12) United States Patent
Holler

(10) Patent No.: US 8,047,401 B2
(45) Date of Patent: Nov. 1, 2011

(54) SYSTEMS AND METHODS OF DISPENSING INDIVIDUAL SERVINGS OF FLAVORED AND ENHANCED WATER

(75) Inventor: Thomas D. Holler, Glastonbury, CT (US)

(73) Assignee: 3M Innovative Properties Company, St. Paul, MN (US)

( * ) Notice: Subject to any disclaimer, the term of this patent is extended or adjusted under 35 U.S.C. 154(b) by 1277 days.

(21) Appl. No.: 11/421,553

(22) Filed: Jun. 1, 2006

(65) Prior Publication Data

US 2007/0012719 A1 Jan. 18, 2007

Related U.S. Application Data

(60) Provisional application No. 60/686,604, filed on Jun. 2, 2005.

(51) Int. Cl.
*B67D 1/00* (2006.01)
*B67D 7/14* (2006.01)

(52) U.S. Cl. ..... 222/61

(58) Field of Classification Search ..... None
See application file for complete search history.

(56) References Cited

U.S. PATENT DOCUMENTS

| | | | | |
|---|---|---|---|---|
| 4,220,259 | A | 9/1980 | Lagneaux | |
| 4,473,003 | A * | 9/1984 | Stone, Jr. | 99/305 |
| 5,554,400 | A * | 9/1996 | Stipp | 426/78 |
| 2004/0168973 | A1 | 9/2004 | Hughes et al. | |
| 2005/0076785 | A1 | 4/2005 | Tebo et al. | |

FOREIGN PATENT DOCUMENTS

| | | |
|---|---|---|
| EP | 1 522 245 A1 | 4/2005 |
| FR | 1476354 | 4/1966 |

OTHER PUBLICATIONS

Ipifini, Inc., "Choice-Enabled Packaging," Brochure, 2006 U.S.

* cited by examiner

*Primary Examiner* — Shanon A Foley
(74) *Attorney, Agent, or Firm* — David B. Patchett

(57) ABSTRACT

Novel systems and methods for operatively utilizing nutrient/flavor impregnated media(s) operatively contained in devices, such as, for example, product structures or the like, capable of introducing the nutrients/flavors in a single serving (4-12 oz) dose packets, or multiple servings, such as, for example, a pitcher (up to $64^+$ oz) or a gallon or half gallon of flavored and enhanced water operatively connected to complimentary dispensing system, presently preferably, tied to a water filtration device, such as, for example, bottle less water coolers and one that could be mounted inside a refrigerator dispensing system, and the manufacture of such low cost media(s) and dispensing systems.

13 Claims, 16 Drawing Sheets

SYSTEMS AND METHODS OF DISPENSING INDIVIDUAL SERVINGS OF FLAVORED AND ENHANCED WATER

RELATED APPLICATIONS

This application is a continuation-in-part of commonly owned U.S. Provisional Patent Application Ser. No. 60/686,604, filed Jun. 2, 2005, of Holler, entitled "SYSTEMS AND METHODS OF DISPENSING INDIVIDUAL SERVINGS OF FLAVORED AND ENHANCED WATER," the disclosure of each is herein incorporated by reference to the extent not inconsistent with the present disclosure.

BACKGROUND OF THE DISCLOSURE

The subject disclosure relates to innovative systems and methods of dispensing servings, individual and/or multiple, of flavored and enhanced water, more particularly to media(s) capable of introducing nutrients/flavors in single servings (4-12 oz) or multiple servings, such as, for example, a pitcher (up to 64+ oz), or a gallon or half gallon and/or pharmaceuticals in a single serving (1-2 oz) dose packet, the media(s) being operatively contained in appropriate means or structure such as, for example, packets/cards or similar devices/structures as may be found to accomplish the desired function, operable with the dispensing systems and methods and most particularly to complimentary dispensing systems and methods operatively associated with or without a water filtration device for dispensing the individual servings (4-12 oz) or multiple servings, such as, for example, a pitcher (up to 64+ oz) or a gallon or half gallon or more of flavored and enhanced water and/or pharmaceuticals individual serving (1-2 oz) to consumers.

Noncarbonated water based beverage consumption is on the rise. The fastest growing segment is the enhanced water group, which ranges from vitamins to nutraceuticals to just flavor additives. This segment has grown from about US$ 41.5 million in sales for 1997 to about US$ 985.3 million in sales for 2002 with 2004 projections being about US$ 1.8 billion. Drinking water filter systems have been sold for over 30 years and have enjoyed a steady increase in popularity following the growth of bottled water consumption. Worldwide, bottled water consumption is growing at an annual rate of about 12 percent.

Enhanced waters, a subset of the single-serve water segment, reported the greatest growth figures—albeit off a small base of about US$ 80 million for 2001—with about a 205.8 percent growth to reach about US$ 244.6 million in sales for 2002. (Source: Beverage Marketing Corporation)

Individual serving size and personnel vending are becoming very popular in the US, whereas in Europe and Asia they have been very popular for many years. Most recently, the single cup (bean to cup) coffee makers produced by the entire major US and European brands (Milita, Bunn, Krupp, P&G, etc.) have become popular. Individual pods of fresh ground coffee are used costing the customer about 10 to about 15 times more for a cup of coffee than from an auto drip coffee maker. The above was calculated based on the following: a 39 oz can of ground coffee at a price of about $5.85 yields about 175 cups of coffee or about $0.033 to about $0.045 per 6 oz cup, depending on how much coffee one puts into the machine. The pods retail for about $0.50 per cup.

It is believed that the consumer acceptance of this tremendous increase in cost is driven by a desire for convenience, flavor and versatility, and the notion that one is saving money over the high cost of specialty coffee-shop coffee. This approach appears to be great for the millions of consumers that only drink one or two cups of coffee a day.

Concerning bottled water, Coca-Cola's Dasani is a mineral enhanced bottled water, which has a slightly grainy appearance, actually has a somewhat pleasant taste, unlike many other bottled waters which taste like plastic. Additionally, Canadian O+2 Berry Citrus flavor bottled water is clearly a very refreshing flavored water. Canadian O+2 Berry Citrus flavor bottled water has about 5 times the normal concentration of oxygen, a refreshing citrus/berry flavor and a very subtle, but sweet, flavor. The splash of natural fruit flavoring is just the thing—not too much, not too little. Overall, a very refreshing beverage that offers the benefit of added oxygen.

Rescue Vitamin Water is truly the gem of this variety. Flavored with green tea, this beverage has a potent tea flavor that will quickly quench any thirst. Further, it is fortified with several vitamins and herbs (from the tea) that will put you in a calm and pleasant state within the first few sips.

Red Bull is a utility drink to be consumed when faced with mental or physical weariness or exhaustion. Red Bull combines two natural substances and important metabolic transmitters, the amino acid taurin and glucuronolacton, with stimulating caffeine, vitamins and the energy provided by carbohydrates. The two most popular brands of sport drinks with metabolic transmitters are Gatorade and PowerAde.

The sale of drinking water systems is believed to be mainly based on fear, doubt and uncertainty. Most sales personnel however, would not admit that they use those tactics. For filtered water to gain the popularity that most knowledgeable professions believe is possible, water filtration systems have to be transformed from systems that just remove unwanted or unnecessary elements and compounds from water, to systems that enhance health, wellness, well being and life style, as well as offering convenience and cost savings over the available alternatives. Adding additional performance enhancement claims to an existing water filter system has driven the sellers need for differentiation, but consumers do not recognize or understand the enhancement/performance claims. Simple filters with simple performance claims that consumers recognize are the reduction of chlorine, taste & odor, sediment. In addition, to a lesser extent, claims such as cyst and lead reduction are less consumer recognizable. Now performance enhancing claims include chemicals like Carbofuran, 2,4-D, chlorobenzene and tetrachloroethalene, which unless you are a chemist working in consumer products, you would not know or recognize any of these chemicals. However, all are chemicals listed on the EPA's primary list of hazardous materials. Filter manufacturers select from the EPA's list those chemicals most easily removed with the media they use to manufacture their particular products, while sellers want to be able to say that their particular filtration system provides additional chemical removal or provides something different to enhance the product for the system in order to reduce price competition.

Consumer filtration systems have been estimated to be about a $2+ billion dollar market. Drinking water filtration systems make up less than about 25% or about $450 million (Frost & Sullivan & Baytel) of the total estimated amount, while the refrigerator filter market has jumped from nothing in 1998 to an estimated $300+ million in retail dollars in 2004; 30 years of selling fear, doubt and uncertainty versus 5 years of selling convenience. Filtration has been successfully added to high-end coffee machines offering enhanced flavor.

It is estimated that, by 2006, every major refrigerator manufacturer will likely have incorporated a water filter system into those refrigerator models that dispense water and/or ice. It is also estimated that about 50% of the total 30 million unit yearly global refrigerator output could have a built-in water filter system, with the US market fast approaching the 50% mark in mid 2004. The average life of a refrigerator is about 10-12 years. Less than 15% of the US and European refrigerator markets are for new units with the balance being replacement market. Asia, mainly China and India, are less reliant on the refrigerator replacement market. With the US having between 107-116 million house holds and a production rate of 9 million refrigerators a year (with imports making up only a 2% share), the US refrigerator market will most likely be saturated by 2012, with a market potential (at today's retail price) of about $3 billion, or about $600 million manufacturing dollars.

Of the 59 million French, the issue of obesity is becoming increasingly important. In France, it is estimated that about 5.4 million French are now considered obese, an increase of 1.1 million within only three years. Of the about 300 million Americans, about 23% are now considered obese by body mass. With this in mind, it would appear that bottled waters and low calorie flavored waters are facing much better times ahead than sugary soft drink products.

The cost of bottled water has, until recently, not been a major consumer issue. However, 40,000 16 oz bottles of water can be transported by truck at a cost of about $20/cwt interstate and about $60/cwt intrastate, which adds about $0.20 to about $0.60 per bottle cost. Storage, transportation and retail shelf space are all increasing further affecting the selling price and profit of bottled waters.

The systems and methods of the present disclosure including the devices/appliances and supportive impregnated medias envisioned capitalizes on the fastest growing segments surrounding the filtration industry, that being filtration in appliances and enhanced non-carbonate waters. Both segments are growing at a rate of about 400.0% to about 50.0% per year while drinking water stand-alone systems only manage 12% or less.

When compared to the competitive product, bottled water, the systems and methods of the present disclosure including the device/appliance and supportive impregnated medias envisioned, require no lugging or storing of cases of water, no wasted time or expense mixing up a half gallon to get one drink, although such could be accomplished utilizing the concepts and teachings of the present disclosure, is readily available when an individual wants it, is variable on demand and can be nutritional and beneficial to a healthy fast paced life style.

What is needed are innovative systems and methods for transferring ingredients in a solid/semi-solid state to a liquid such as; for example, water wherein the ingredients are sufficiently dissolved into the liquid/water. Such systems and methods may include a transfer device operative for transferring ingredients in a solid/semi-solid state to a liquid such as water wherein the ingredients are sufficiently dissolved into the liquid. Possible ingredient transfer devices include, but are not limited to, media(s) capable of being impregnated and/or permeated and/or infused with a nutrient/flavor and/or pharmaceutical, which when placed into a steam of liquid such as water can introduce the nutrients/flavors in a single serving (4-12 oz) dose or multiple servings, such as, for example, a pitcher (up to 64+ oz,) and/or the desired pharmaceuticals in a single serving (1-2$^{+}$ oz) dose, the media(s) being operatively contained in appropriate means or structure such as, for example, packets/cards or similar devices/structures as may be found to accomplish the desired function. Further, a complimentary dispensing system and associated methods may be useful when operatively associated with a water filtration device, which may include, but is not limited to, stand alone dispensing systems, OEM version dispensing systems for inclusion into bottled water and bottle less water coolers, vending machines, faucets and refrigerator dispensing system and other similar systems as may become available in the future, the media(s) and dispensing systems should be manufactured at a reasonably low cost in order to be competitive in the market place.

SUMMARY OF THE DISCLOSURE

The present disclosure provides innovative systems and methods of dispensing servings, individual and/or multiple, of flavored and enhanced water, more particularly to media(s) capable of introducing nutrients/flavors in single servings (4-12 oz) or multiple servings, such as, for example, a pitcher (up to 64+ oz), or a gallon or half gallon and/or pharmaceuticals in a single serving (1-2 oz) dose packet, the media(s) being operatively contained in appropriate means or structure such as, for example, packets/cards or similar devices/structures as may be found to accomplish the desired function, operable with the dispensing systems and methods and most particularly to complimentary dispensing systems and methods operatively associated with or without a water filtration device for dispensing the individual servings (4-12 oz) or multiple servings, such as, for example, a pitcher (up to 64+ oz) or a gallon or half gallon of flavored and enhanced water and/or pharmaceuticals for individual servings (1-2 oz) to consumers.

In one embodiment of the present disclosure, a system for transferring sufficient amounts of any one of a plurality of selected ingredients to a liquid comprising: a product structure, the product structure including structure capable of storing sufficiently controlled amounts of any one of the plurality of selected ingredients therein for controlled release upon sufficient contact with a liquid; and a liquid enhancing transfer mechanism, operative to house the product structure and to facilitate the flow of liquid to the product structure and to transfer the resultant mixture from the product structure to a remote location.

In yet another embodiment of the present disclosure, a method for transferring sufficient amounts of any one of a plurality of selected ingredients to a liquid comprising the acts of: providing a product structure; storing sufficient amounts of any one of the plurality of selected ingredients in the product structure; providing a supply of a liquid; providing a liquid enhancing transfer mechanism, operative to house the product structure and to facilitate the flow of liquid to the product structure from the liquid supply and from the product structure to a remote location; initiating the flow of liquid from the liquid supply to the product structure; upon sufficient contact with the liquid from the liquid supply, releasing a sufficient amount of the stored ingredients into the liquid to form a mixture thereof; and transferring the resultant mixture from the liquid enhancing transfer mechanism to the remote location.

Other objects and advantages of the present disclosure will be apparent from the following description, and the accompanying drawings.

BRIEF DESCRIPTION OF THE DRAWINGS

So that those having ordinary skill in the art to which the subject disclosure pertains will more readily understand how to make and use the filtration assembly of the subject disclosure, preferred embodiments thereof will be described in detail herein below with reference to the drawings, wherein.

ENABLING DESCRIPTION OF REPRESENTATIVE EMBODIMENTS

Figure 1:
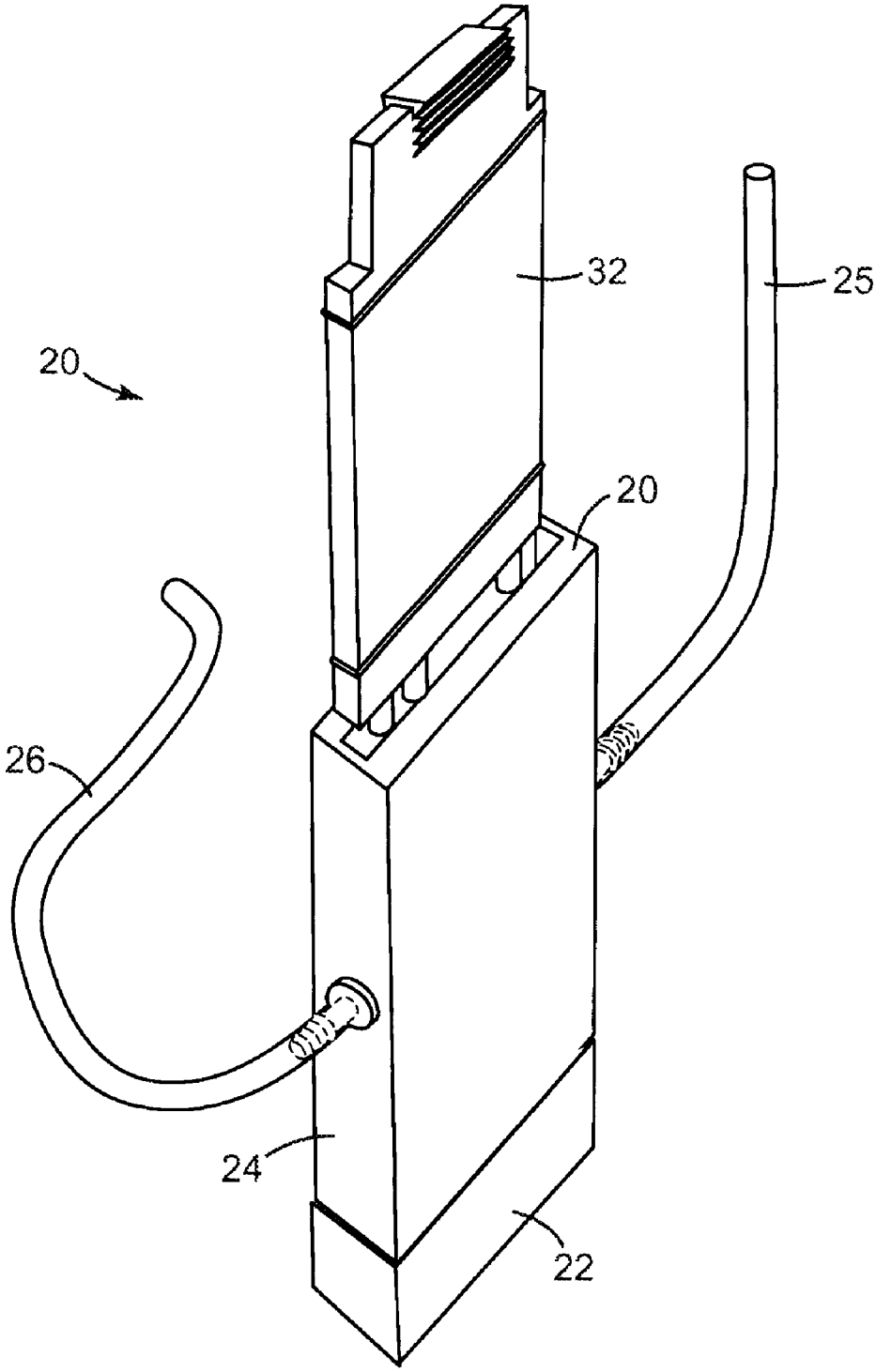
FIG. 1 is a perspective schematic representation of one of a plurality of possible liquid enhancing transferring mechanisms according to the present disclosure.
Figure 2:
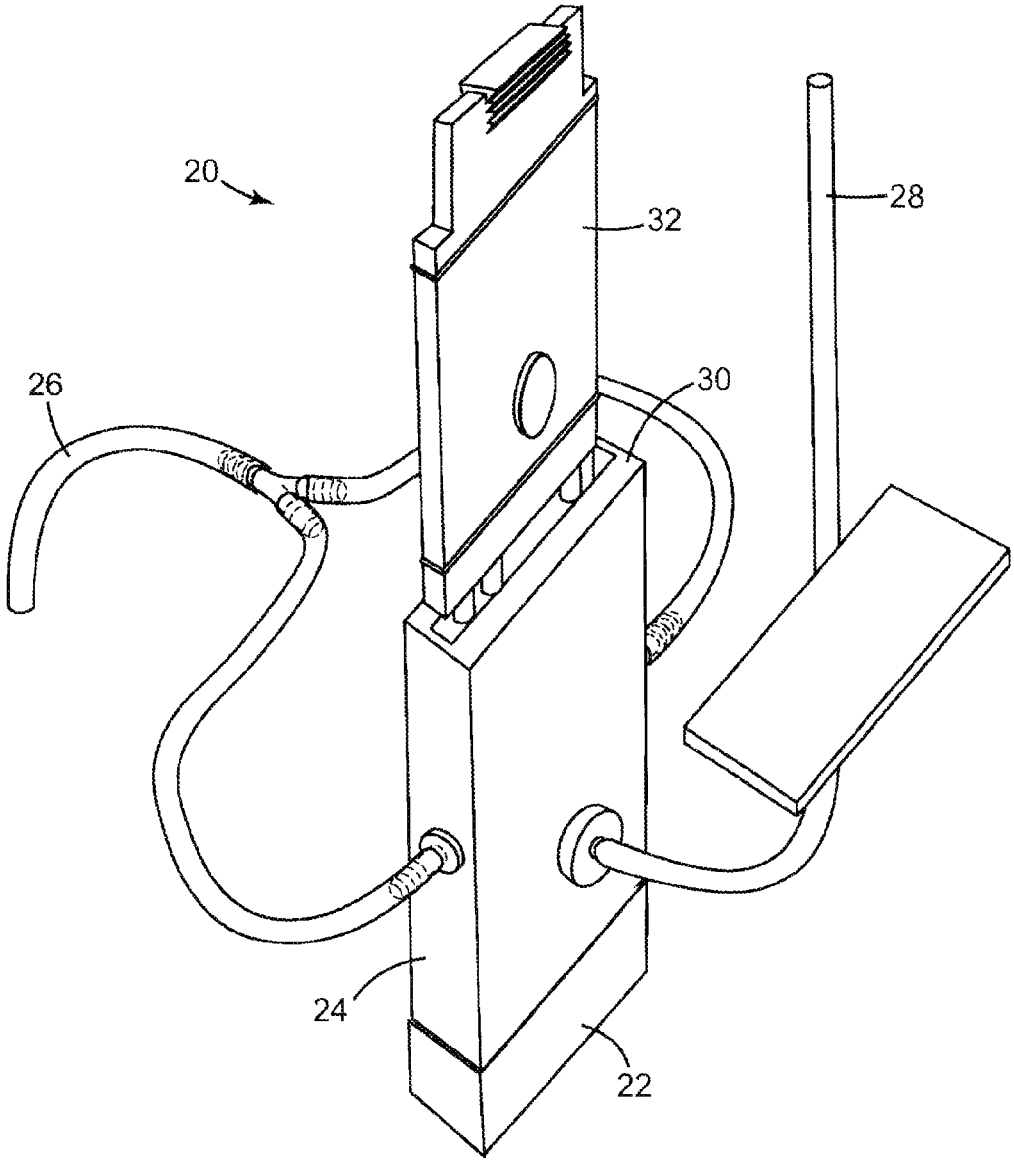
FIG. 2 is a perspective schematic representation of one possible alternative embodiment of a plurality of possible liquid enhancing transferring mechanisms according to the present disclosure.
Figure 3A:
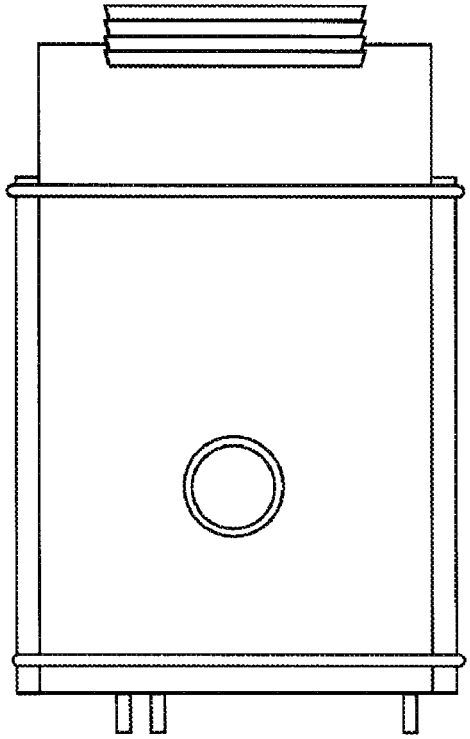
FIG. 3A is a top view of the representative embodiment of the liquid enhancing ingredient transferring mechanism product structure of FIGS. 1 and 2 according to the present disclosure.
Figure 3B:
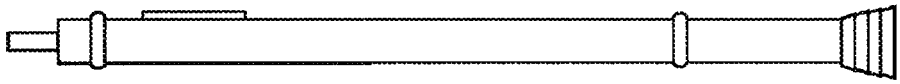
FIG. 3B is a side view of the representative embodiment of the liquid enhancing ingredient transferring mechanism product structure of FIG. 3A.
Figure 3C:
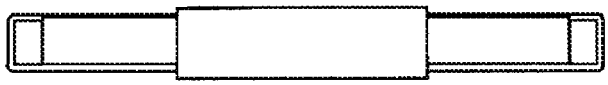
FIG. 3C is a front view of the representative embodiment of the liquid enhancing ingredient transferring mechanism product structure of FIGS. 3A and 3B.
Figure 3D:
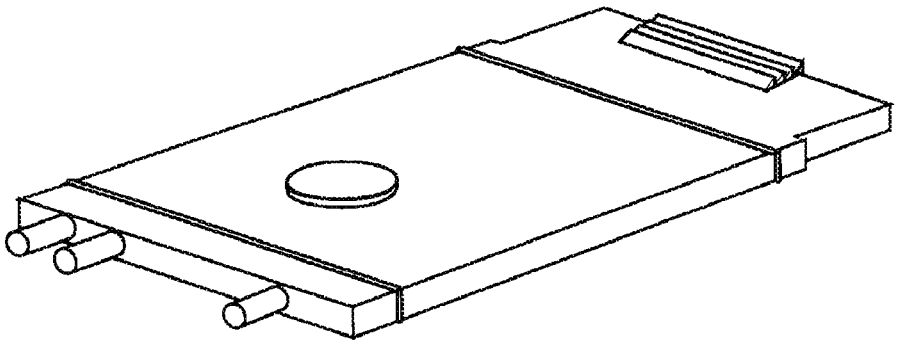
FIG. 3D is a perspective schematic view of the representative embodiment of the liquid enhancing ingredient transferring mechanism product structure of FIGS. 3A-3C.
Figure 3E:
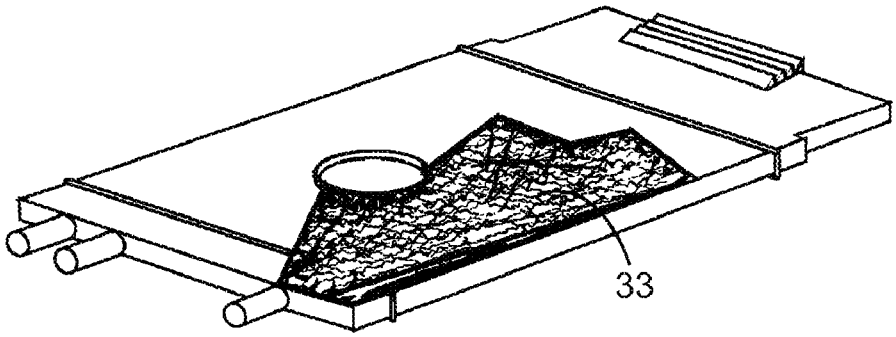
FIG. 3E is a perspectives schematic view with parts removed to reveal the porous media of the representative embodiment of the liquid enhancing ingredient transferring mechanism product structure of FIGS. 3A-3D.
Figure 4A:
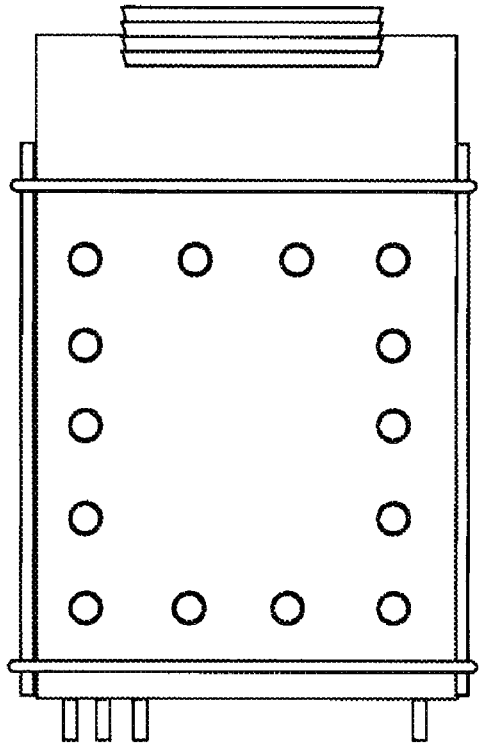
FIG. 4A is a top view of another of the plurality of possible representative embodiments of the liquid enhancing ingredient transferring mechanism product structure of FIGS. 1 and 2 according to the present disclosure.
Figure 4B:
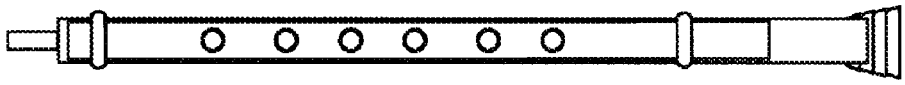
FIG. 4B is a side view of the representative embodiment of the liquid enhancing ingredient transferring mechanism product structure of FIG. 4A.
Figure 4C:
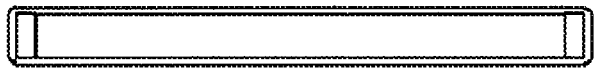
FIG. 4C is a front view of the representative embodiment of the liquid enhancing ingredient transferring mechanism product structure of FIGS. 4A and 4B.
Figure 4D:
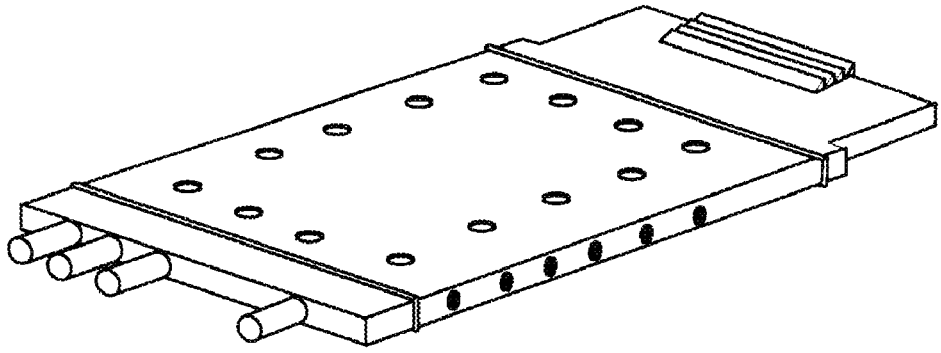
FIG. 4D is a perspective schematic view of the representative embodiment of the liquid enhancing ingredient transferring mechanism product structure of FIGS. 4A-4C.
Figure 4E:
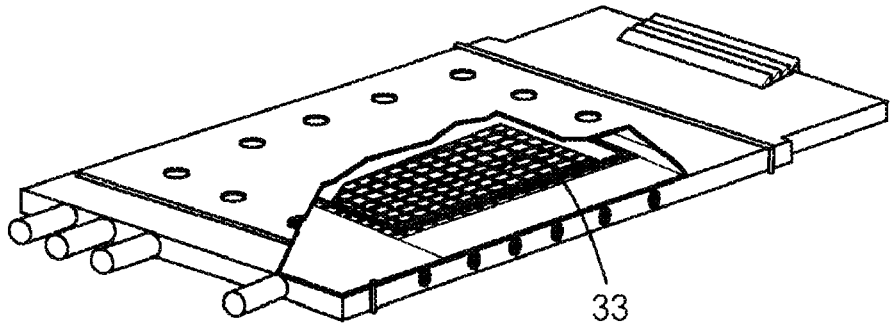
FIG. 4E is a perspectives schematic view with parts removed to reveal the porous media of the representative embodiment of the liquid enhancing ingredient transferring mechanism product structure of FIGS. 4A-4D.

The present disclosure is directed to systems and methods for transferring ingredients in a solid/semi-solid state to a liquid, such as, for example, water wherein the ingredients are sufficiently dissolved into the liquid/water. Possible representative ingredient transfer devices include, but are not limited to, media(s) capable of being impregnated and/or permeated and/or infused with a nutrient/flavor and/or pharmaceutical, which, when placed into a steam of liquid such as water can introduce the nutrients/flavors in a single serving (4-12 oz) dose or multiple servings, such as, for example, a pitcher (up to 64+ oz) and/or the desired pharmaceuticals in a single serving (1-2+ oz) dose, the media(s) being operatively contained in appropriate means or structure such as, for example, packets/cards or similar devices/structures as may be found to accomplish the desired function. Further, a complimentary dispensing system may be useful when operatively associated with a water filtration device, which may include but is not limited to, stand alone dispensing systems, OEM version dispensing systems for inclusion into bottled water and bottle less water coolers, vending machines, faucets and refrigerator dispensing systems, the media(s) and dispensing systems should be manufactured at a reasonably low cost in order to be competitive in the market place. The systems and methods of the present disclosure could function with or without the water filtration component.

One uniqueness of the present innovation is the ability of the product structure construction in concert with the dispenser to overcome the typical obstacles and inconveniences of dry power packets and tablets (currently on the market) which are difficult to dissolve, requiring extensive shaking or stirring, and poor packaging, Also current packets are more conducive to spilling of the ingredients as one tries to introduce them into a glass or bottle of water, than directional control. Finer and finer powders are being used to improve speed of dissolution, but also cause ingredients to be introduced into the air causing eye, nose and throat irritation as well as a dusting out problem of surrounding fixtures.

Representative dispensing systems, both as stand alone devices, and as OEM versions are presently envisioned for inclusion into bottled water and bottle less water coolers as well as systems capable of being mounted inside refrigerator dispensing systems, the systems including low cost media(s) operative for dispensing the single serving (4-12 oz) dose packets to consumers via the dispensing systems.

Although the present innovation is envisioned to operate as a stand-alone device, enhancing the process with selective filtration offers multiple advantages. The dispensing mechanism can be a useful clean water outlet as found in refrigerators, water coolers and drinking water systems, dispensing quality drinking water without enhancements, flavors or nutraceuticals. The other useful purpose is the influence filtered water has on the dissolution rate of the ingredients. Lowering the Total Dissolved Solids (TDS) or the cleaner the water the more rapid and complete the dissolution of the ingredients.

As depicted in the examples below.

For Residential markets
Week Acid Cation (WAC) resin and Activated Carbon
or Reverse Osmosis
For Commercial markets
Carbon/Sediment/WAC
or Reverse Osmosis
For Medical markets
Reverse Osmosis+UV
and/or Deionization
The System Referring now to the drawings, FIGS. 1-4 illustrate representative systems for transferring sufficient amounts of ingredients, such as for example, liquid flavoring, vitamins, minerals, medicine to the liquid/water according to the present disclosure and includes at least one ingredient transferring mechanism for enhancing liquids. One presently preferred representative liquid enhancing ingredient transferring mechanism 20 includes, but is not limited to, at least one mechanical fill control device 22, at least one ingredient insertion device or housing 24 having at least one means or structure for receiving incoming liquid/water 26 operatively connected thereto, at least one means or structure for delivering flavored water to a remote location 28 operatively connected thereto and at least one means or structure for operatively receiving and housing an ingredient transfer device 32 such as, for example, a product structure, the product structure 32 being about the size of a credit card, although any size and shaped device that sufficiently performs the desired function, such as, for example, being insertable into an access structure or slot 30, such as, for example, a slot, access panel, door cover, or other equivalent structure such that once the liquid enhancing ingredient transferring mechanism 20 is activated by an affirmative action including, but not limited to, pushing a button, pulling a lever, etc., see FIGS. 5-13. Such action results in the movement of the liquid from the incoming water supply to and operatively through the ingredient transfer device 32 such that the ingredients contained in the ingredient transfer device 32 are substantially transferred to the liquid, the thus ingredient enhanced liquid then being transmitted to the remote location 28 where the outpouring of a delicious carbonated or non-carbonated flavored drink from the system is received for enjoyment by an end user/consumer.

As presently envisioned, in operation, a system operator, presently preferably, could choose different flavors or different enhancements for the liquid, presently preferably, filtered water each and every time, or just plain refreshing great tasting filtered water, although filtered water is not absolutely required, according to the present disclosure. The liquid enhancing transferring mechanism of the present disclosure can supply at least two desirable liquid/water qualities, one, that is good to the taste, and one, that is more aggressive, capable of rapidly dissolving organic flavors, powdered vitamins & minerals or any other similar material capable of being dissolved in liquids/water and that result in a desirable enhanced consumable liquid/water end product.

The liquid enhancing ingredient transferring mechanism 20 of the present disclosure may optionally comprise a suitable device, such as, for example, a structure capable of microbial reduction (viruses and bacteria removal) to provide very high quality liquid/water for enhancement by the ingredient transferring mechanism according to the present disclosure.

Figure 5:
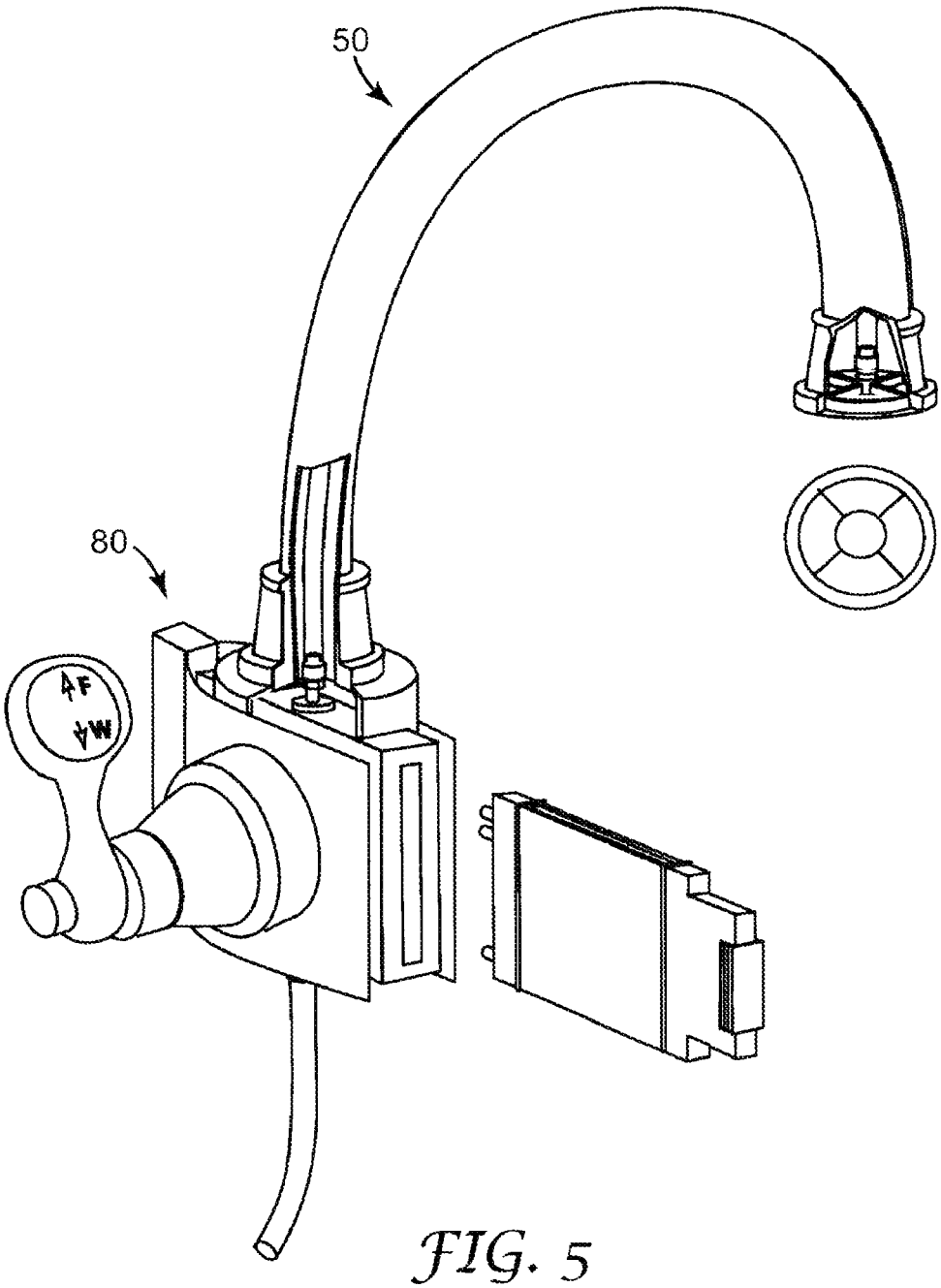
FIG. 5 is a perspective schematic view of one a plurality of possible representative embodiments of a system for utilization of the liquid enhancing transferring mechanism according to the present disclosure.
Figure 6:
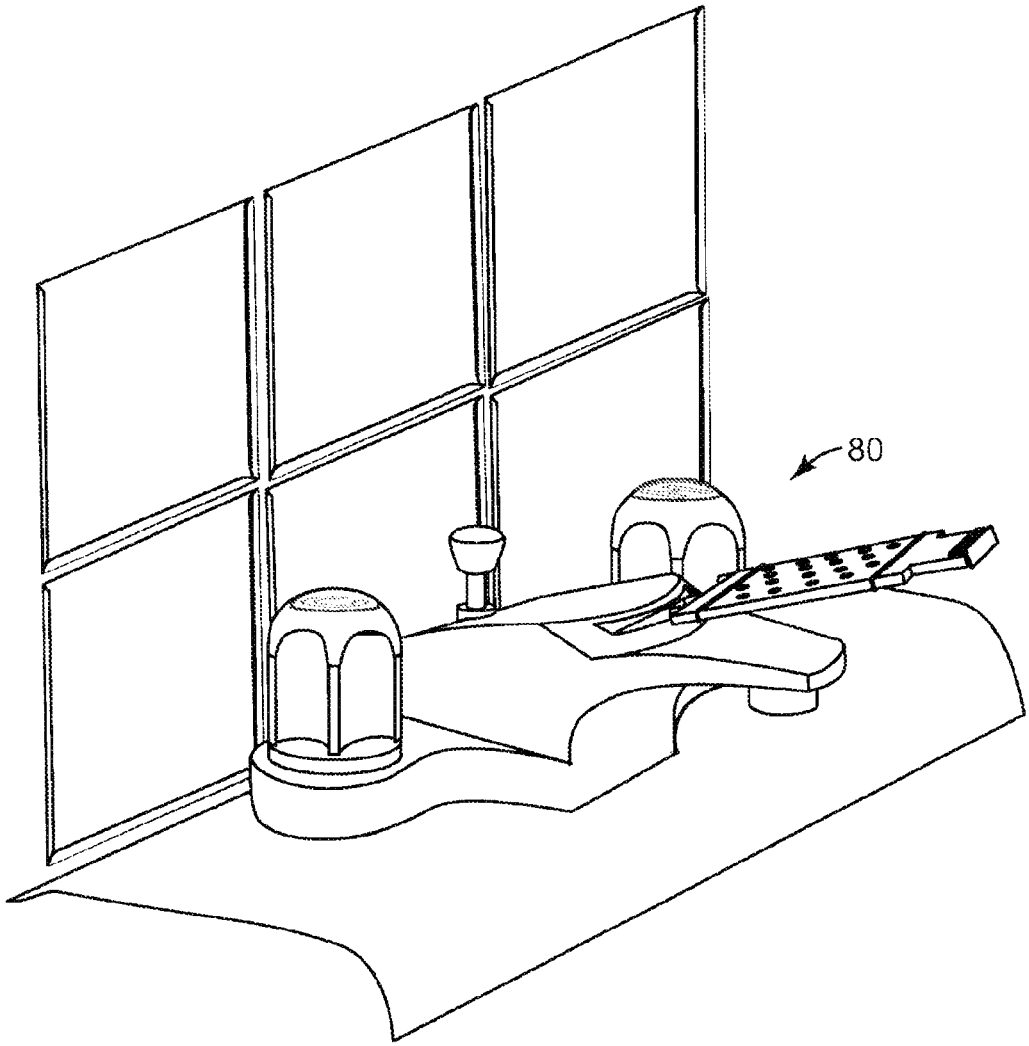
FIG. 6 is a perspective schematic view of another of the plurality of possible representative embodiments of a system for utilization of the liquid enhancing transferring mechanism according to the present disclosure.

As illustrated in FIGS. 5-13, complete representative systems of the ingredient transferring mechanism 20, according to the present disclosure, are sufficiently compact to easily fit under a kitchen or bathroom sink, be installed internal to a refrigerator or be installed as part of a stand alone water cooler or in other suitable locations, as could be imagined by those skilled in the art. The liquid enhancing ingredient transferring mechanism 20 receiving access structure 30, such as, for example, a slot may be conveniently located next to the dispensing faucet above the sink, as shown in FIGS. 5-6.

One representative ingredient transfer device 32 or media containing product structure could contain one drink premeasured or, if possible, two or more up to the physical capacity of the media contained within the representative media containing product structure 32. Each media containing product structure 32 could be operatively connected, electronically, mechanically or in any operative manner, to communicate to a liquid delivery system 50 indicating the volume of liquid to be dispensed. Flavor intensity can be readily varied based on the dispensed volume. The liquid delivery system 50 can be modified to deliver chilled liquid/water. A hot water dispensing capability can also augment the capability of the liquid delivery system for dissolving nutraceuticals at a faster rate. One clear advantage of the systems and methods of the present disclosure is that medicines that are normally mixed with water and drunk hot or cold could now be dispensed nearly instantly, see FIG. 13. Representative liquid delivery systems 50 of the preset disclosure would, presently preferably, monitor both the number of dispenses and the amount of filter liquid/water but other representative liquid delivery system of the present disclosure could adequately function without these control features.

As should be evident, the product access structure 30 receptor or slot would be adapted to be capable of opening a protective means or structure, such as, for example, a sealed protective pouch surrounding the product structure, as necessary, directing the liquid/water flow through the impregnated media, presently preferably, porous through either a gravity flow or pressurized system. The liquid delivery systems of the present disclosure flushes (purges) the liquid/water line and delivery structure, such as, for example, a faucet at the end of each enhanced liquid or product dispensed. The purged liquid/water can either be the last volume dispensed into a cup or ejected to a drain. Once the product structure is used, the product structure can be removed either manually or automatically discarded into a waste receptacle from the liquid delivery access structure or slot 30 and another liquid enhancing ingredient transferring mechanism inserted, or it can be automatically discarded into a waste receptacle. The waste receptacle would be periodically emptied and replaced, as appropriate. The dispensing device would be capable of dispensing measured amounts of liquid/water from a selector panel, as well as, hot, chilled or ambient liquid/water, as would be understood by those skilled in the art.

One representative media element 33, see FIGS. 3 and 4, believed usable with the systems and methods of the present disclosure include an element having a non-dissolving porous structure, which carries (or is impregnated with) the different flavors etc., and is envisioned to, presently preferably, be hydrophilic. As is known to those skilled in the art, a hydrophilic media element would allow the media to wet out quickly. It is also envisioned that non-hydrophilic media elements could also be used. It is envisioned that the media elements would, presently preferably, be initially processed in either sheet or roll form and then cut into individual media, and sealed in moisture proof pouches for incorporation into liquid enhancing product structures.

The presently preferred highly porous structure media element 33 would be sized to suitable dimensions, such as, for example, a thickness of about ⅛ inch to about ¼ inch so that liquid/water would flow either axially from one end to the other or radially therethrough. As presently envisioned, the processing can be either a dry process with the porous media element being charged which would moderately hold the powered ingredients, or a wet process where the ingredients are allowed to dry on the porous structure of the media element. Different ingredients and combination of ingredients may require a combination of various types of processing to obtain the desired concentration in the resultant liquid.

Another possible representative ingredient transfer device media element comprises a card shaped element that could be comprised solely of the ingredients either in powdered form or pressed into a rigid structure. Such a structure would be sealed in individual packets. Another representative ingredient transfer device card type variation would be a multi media semi rigid structure wherein the ingredient carrier media would be sandwiched between two porous hydrophobic layers. The hydrophobic layers would prevent moisture from humidity from prematurely wetting out the ingredient carrier layer, but allowing a sufficient flow to the ingredient carrier layer and back out in a pressurized liquid dispensing system.

A portion or the entire representative structure could be impregnated with the ingredients. The structure either could be completely inserted into the liquid dispensing system or could have one edge that acts as a handle and/or seal, which would remain partially exposed for easy insertion and removal of the structure from the liquid dispensing system.

Presently, it is believed that the most popular ingredients for individual served beverages, natural and artificial Flavors, Soy, Calcium, Fiber, & Antioxidants, are believed to be the best candidates for incorporation into the media elements of the ingredient transferring mechanism.

Whether it is a flavor or a nutraceutical, all ingredients should be provided dry on the media element, such as, for example, the product structure 32. It is believed that providing the ingredients in the dry state would provide a longer shelf life for the media elements contained inside the product structure. Most ingredients, if not all, would, presently preferably, use non-sugar based sweeteners. Artificially sweetened flavored ingredients could be offered as stand-alone media elements or be combined with a nutraceutical, or combination of nutraceuticals. All ingredients would, presently preferably, be highly soluble in liquid/water. It is believed that the combination and intensity of certain flavored ingredients will help mask the less desirable tastes of some nutraceuticals. The following is a representative partial disclosure of some ingredient presently believed to be desirable for utilization with the present disclosure.

Calcium is an ingredient in demand these days on the consumer level. Bones may continue to do well thanks to Gluconal CAL, a premium product for calcium fortification. Gluconal CAL has been put together with neutral taste and "excellent" solubility and as such, would be an excellent candidate for inclusion as an ingredient in the media elements of the present disclosure. Details relating to Gluconal CAL can be found at the web site www.avebe.com, the disclosure of which is incorporated herein by reference to the extent not inconsistent with the present disclosure.

Soy Prolísse 500, from Cargill's Soy Protein Solutions division, is one of a number of soy ingredients launched in recent years to meet new demand. Nevertheless, the company claims that its patented technology has achieved a breakthrough in taste, creating a bland-flavored isolate that when included in a beverage, does not give the beverage the undesirable soy beany taste. Soy Prolísse 500, also has good solubility and smooth mouth feel, well-suited to a variety of beverages including dairy-like, juice base, energy and weight-loss products, according to Cargill. It is presently believed that Soy Prolísse 500 would be an excellent potential ingredient for inclusion as an ingredient in the media elements contained inside the product structure of the present disclosure.

It is believed possible to incorporate a considerable number of ingredients containing antioxidants into the media elements of the present disclosure. Specifically, it is believed that Vinpocetine, an additive that "if applied in functional beverages may help those with memory disorders" could be included in certain media elements of the present disclosure. Likewise, Vitamin E 230 Clear, a new water-soluble form of natural-source vitamin E from Archer Daniels Midland, Decatur, Ill., that enables formulators to create clear beverages with natural vs. synthetic vitamin E could be incorporated into the media elements of the present disclosure. Further, Lycopene and lutein are two well-respected ingredients in the nutritional supplement industry and could be incorporated into the media elements of the present disclosure. Utilizing Lutein's "complementary" eye health carotenoid, zeaxanthin, is currently approved for supplement use and will most likely obtain self-affirmed GRAS, a European regulatory agency, status sometime in 2003 and could be incorporated into the media elements of the present disclosure. "The benefit of having a separate form of zeaxanthin for product developers is that marketers will be able to add enough to then achieve the 5-to-1 ratio of lutein to zeaxanthin documented in epidemiological studies for contributing to eye health."

Examples of typical combinations of flavors and nutraceuticals follow: The use of ribose ("the primary source of cellular energy") is this product's key ingredient.

Ingredients: Vapor distilled water, crystalline fructose, natural flavor, citric acid, ribose, ascorbic acid (vitamin C), magnesium lactate (electrolyte), calcium lactate (electrolyte), vitamin E acetate, monopotassium phosphate (electrolyte), niacin B3, pantothenic acid (B5), pyridoxine hydrochloride (B6), canthaxanthin (color), and cyanocobalamin.

Nutrition Facts: Serving size 8 fl oz, calories 50, total fat 0 g, sodium 0 mg, total carbohydrates 13 g, sugar 13 g, protein 0 g, vitamin A 10%, vitamin B3 10%, vitamin B5 10%, vitamin B6 10%, vitamin B12 10%, vitamin C 60%, vitamin E 10%, astragalus 25 mg, Siberian ginseng 25 mg Fortified with several vitamins and herbs (from the tea) that will put you in a calm and pleasant state within the first few sips.

Ingredients: Vapor distilled water, crystalline fructose, citric acid, green tea, natural flavor, ascorbic acid (vitamin C), electrolytes (Calcium, magnesium, and potassium), rosemary, chamomile, hibiscus, lavender, and rose hips extracts, niacin (B3), cyanocobalamin (B12), pyridoxine hydrochloride (B6)

Nutrition Facts: Serving size 8 fl oz, calories 40, total fat 0 g, sodium 0 mg, total carbohydrate 9 g, sugar 8 g, protein 0 g, vitamin B3 25%, vitamin B5 25%, vitamin B6 25%, vitamin B12 25%, vitamin C 100%, rosemary 20 mg, chamomile 20 mg, hibiscus 20 mg, lavender 20 mg, rose hips 20 mg As stated in the above examples of ingredient formulas, distilled water is the main ingredient. Thus, a desirable aspect of the present disclosure would be the use of filtered liquid/water as the medium for transferring the enhancing ingredients from the product structure and delivering the resulting mixture to a consumer. Numerous technologies can be used to produce similar results without the high cost of capital or energy consumption. RO or Resin technologies combined with carbon can also be used. In many cases simple carbon only filtration is sufficient.

In the practice of the present disclosure, the presently preferred technology for providing the liquid/water for adsorbing the enhancing ingredients incorporates both resin technology and carbon integrated into a single filter vessel. (Two separate vessels may be used as well.) A representative filter would be capable of delivering two different qualities of water. For fresh filtered tap water, a carbon block would be the main filtration media with competitive claims to current market conditions. The estimated capacity for a 6 month life is 350 gallons (5600 8 oz servings). The resin portion would be capable of reducing background minerals and delivering a slightly acidic pH. Two separate flow paths through the liquid enhancing transferring mechanism and dispensing faucet would minimize the need for flushing after each serving. Water passing through the resin and carbon would be used to rapidly dissolve the dry ingredients. The estimated capacity for a 6 month life would be 50 gallons (1000 4-6 oz servings).

Sample Ingredient lists of current enhanced water suppliers include, but are not limited to the following:

Multi-V: Ingredients: Vapor distilled water, crystalline fructose, natural flavor, citric acid, ascorbic acid (vitamin C), electrolytes (Calcium, magnesium, and potassium), vitamin A palmitate, and vitamin E acetate. Nutrition Facts Serving size 8 fl oz, calories 40, total fat 0 g, sodium 0 mg, total carbohydrate 9 g, sugar 8 g, protein 0 g, vitamin A 100%, vitamin C 100%, vitamin E 100%, calcium 20 mg.

Stress-B: Ingredients: Vapor distilled water, crystalline fructose, citric acid, natural flavor, ascorbic acid (vitamin C), gum Arabic, electrolytes (Calcium, magnesium, and potassium), gum ester, St Johns wort and kava kava extracts, niacin (B3), pantothenic acid (B5), riboflavin (B2), cyanocobalamin (B12), pyridoxine hydrochloride (B6). Nutrition Facts: Serving size 8 fl oz, calories 40, total fat 0 g, sodium 0 mg, total carbohydrate 9 g, sugar 8 g, protein 0 g, vitamin B2 25%, vitamin B3 25%, vitamin B5 25%, vitamin B6 25%, vitamin B12 25%, vitamin C 60%, St Johns wort 25 mg, kava kava 25 mg.

Defense: Ingredients: Vapor distilled water, crystalline fructose, natural flavor, ascorbic acid (vitamin C), electrolytes (Calcium, magnesium, and potassium), arabinogalactan (ImmuneEnhancer™), Echinacea extract, zinc picolinate. Nutrition Facts: Serving size 8 fl oz, calories 40, total fat 0 g, sodium 0 mg, total carbohydrate 9 g, sugar 8 g, protein 0 g, vitamin C 100%, zinc 25%, Echinacea 100 mg, arabinogalactan 50 mg.

Revive: Ingredients: Vapor distilled water, crystalline fructose, natural flavor, citric acid, grape juice (for color), electrolytes (Calcium chloride, magnesium chloride, and potassium bicarbonate), grape skin extract (for color), ascorbic acid (vitamin C), gum Arabic, gotu kola extract, vitamin E acetate, American ginseng extract, niacin (B3), pantothenic acid (B5), ester gum, vitamin A palmitate, pyridoxine hydrochloride (B6), cyanocobalamin. Nutrition Facts: Serving size 8 fl oz, calories 50, total fat 0 g, sodium 0 mg, potassium 30 mg, total carbohydrate 13 g, sugar 12 g, protein 0 g, vitamin A 10%, vitamin B3 10%, vitamin B5 10%, vitamin B6 10%, vitamin B12 10%, vitamin C 60%, vitamin E 10%, gotu kola 25 mg, American ginseng 25 mg.

Focus: Ingredients: Vapor distilled water, crystalline fructose, citric acid, ascorbic acid (vitamin C), gum Arabic, electrolytes (calcium, magnesium, and potassium), vitamin E acetate, gum ester, vitamin A palmitate, niacin (B3), pantothenic acid (B5), gotu kola, siberian ginseng and ginkgo biloba extracts, cyanocobalamin (B12), pyridoxine hydrochloride (B6). Nutrition Facts: Serving size 40, calories 40, total fat 0 g, sodium 0 mg, total carbohydrates 9 g, sugar 8 g, protein 0 g, vitamin A 25%, vitamin B3 25%, vitamin B5 25%, vitamin B6 25%, vitamin B12 25%, vitamin C 100%, vitamin E 25%, ginkgo biloba 25 mg, gotu kola 25 mg, Siberian ginseng 25 mg.

Essential: Ingredients: Vapor distilled water, crystalline fructose, citric acid, natural flavor, calcium lactate, potassium, gum Arabic, ascorbic acid (vitamin C), electrolytes (calcium, magnesium, and potassium), gum ester, vitamin A, palmitate, vitamin E acetate, niacin (B3), pantothenic acid (B5), iron, cyanocobalamin (B12), beta carotene (for color), pyridoxine hydrochloride (B6), selenium. Nutrition Facts: Serving size 8 fl oz, calories 40, total fat 0 g, sodium 0 mg, total carbohydrate 9 g, sugar 8 g, protein 0 g, vitamin A 50%, vitamin B3 25%, vitamin B5 25%, vitamin B6 25%, vitamin B12 25%, vitamin C 25%, vitamin E 25%, calcium 2%, iron 5%, potassium 5%, selenium 5%, zinc 25%.

Balance: Ingredients: Vapor distilled water, crystalline fructose, citric acid, natural flavor, electrolytes (calcium chloride, magnesium chloride, and potassium bicarbonate), gum Arabic, ascorbic acid (vitamin C), natural color, cranberry, black currant and raspberry juice concentrates, zinc picolinate, vitamin E acetate, yerba mate extract, niacin (B3), pantothenic acid (B5), ester gum, ginkgo biloba extract, vitamin A palmitate, pyridoxine hydrochloride (B6), caramel color, selenium, cyanocobalamin (B12). Nutrition Facts: Serving size 8 oz, calories 50, total fat 0 g, sodium 0 mg, total carbohydrates 13 g, sugar 12 g, protein 0 g, vitamin A 10%, vitamin B3 10%, vitamin B5 10%, vitamin B6 10%, vitamin B12 10%, vitamin C 40%, vitamin E 10%, selenium 2%, calcium>2%, zinc 10%.

Power-C: Ingredients: Distilled/deionized, crystalline fructose, citric acid, natural flavor, ascorbic acid (vitamin c), natural flavor extract (for color), electrolytes (calcium, magnesium and potassium), vitamin E acetate, zinc picolinate, taurine, vitamin A palmitate, niacin (B3), pantothenic acid (B5), Siberian ginseng extract, chromium polynicotinate, cyanacolobalamin (B12), pyridoxine hydrochloride (B6), dragonfruit juice concentrate. Nutrition Facts: Serving size 8 fl oz, calories 40, total fat 0 g, sodium 0 mg, total carbohydrate 9 g, sugar 8 g, protein 0 g, vitamin A 25%, vitamin B3 25%, vitamin B5 25%, vitamin B6 25%, vitamin B12 25%, vitamin C 250%, vitamin E 25%, chromium 75%, Zinc 25%, Siberian ginseng 25 mg, Taurine 3 mg.

Energy: Ingredients: Vapor distilled water, crystalline fructose, citric acid, caffeine, ascorbic acid (vitamin C), gum Arabic, natural flavor, electrolytes (calcium, magnesium, and potassium), gum ester, zinc picolinate, vitamin E acetate, vitamin A palmitate, niacin (B3), pantothenic acid (B5), beta carotene, Siberian ginseng and guarana extracts, cyanocobalamin (B12), caramel color, pyridoxine hydrochloride (B6). Nutrition Facts: Serving size 8 fl oz, calories 40, total fat 0 g, sodium 0 mg, total carbohydrate 9 g, sugar 8 g, protein 0 g, vitamin A 25%, vitamin B3 25%, vitamin B5 25%, vitamin B6 25%, vitamin B12 25%, vitamin C 100%, vitamin E 25%, Zinc 10%, Guarana 25 mg, Siberian ginseng 25 mg.

Other possible ingredients include, but are not limited to, popular flavors such as those disclosed below in Table 1 as representative examples. As depicted Table 1, Crystal Light Fruit Flavored Drinks are light refreshment with a fruity twist. There are five delicious flavors to choose from, including Strawberry-Kiwi, Raspberry Ice, and Ruby Red Grapefruit And Crystal Light Fruit Flavored Drinks are caffeine free, sugar free and contain just 5 calories per 8 fl. oz. serving.

| Flavors | |
|---|---|
| Raspbery Ice | * |
| Tropical Passions ™ Strawberry Kiwi | * |
| Tropical Passions ™ Strawberry Orange Banana | * |
| Tropical Passions ™ Pineapple Orange | * |
| Ruby Red Grapefruit | * |

* Available in grocery stores and mass merchandisers.
** Available in warehouse club stores.

One representative core system and method of the present disclosure is schematically illustrated in FIGS. 1-4. With particular attention to FIGS. 1 and 2, the liquid enhancing ingredient transferring mechanism 20 includes, but is not limited to at least one mechanical fill control 22 at least one ingredient insertion device or housing 24 having at least one means or structure for receiving incoming liquid/water 26 at least one means or structure for delivering enhanced/flavored water to a remote location 28 and at least one access structure or slot 30, or means or structure for operatively receiving and housing an ingredient transfer device 32, such as, for example, a product structure, the product structure 32 being about the size of a credit card, although any size and shaped device that sufficiently performs the desired function, such as, for example, being insertable into the at least one means or structure for operatively receiving and housing an access structure 30, such as, for example, a slot, access panel, door cover, or other equivalent structure such that once the system is activated by an affirmative action including, but not limited to, pushing a button, pulling a lever, etc.

Such action results in the movement of the liquid from the means or structure for receiving incoming liquid/water 26 to and operatively through the ingredient insertion device 24 such that the ingredients contained in the ingredient transfer device are substantially transferred to the liquid, the ingredient enhanced water then being transmitted to the remote location, see FIGS. 5-13, the outpouring of a delicious carbonated or non-carbonated flavored drink from the system is received for enjoyment by an end user/consumer.

As shown in FIGS. 3-4, one possible representative product structure 32, according to the present disclosure, is illustrated. The structure of one possible representative product structure 32 is illustrated in FIG. 3 and includes an outer casing 40 for housing a porous media 42 impregnated with flavors and Nutraceuticals. The outer casing 40 includes an inlet 43 for receiving the means or structure for receiving incoming liquid/water 26 into the interior of the outer casing 40 and in contact with the porous media 42. In this particular representative embodiment, the inlet 43 matches the structural configuration of FIGS. 1 and 2. The outer casing further includes an outlet 44 operatively positioned in the outer casing and in fluid communication with the flavor water outlet end location, as described below.

The representative product structure 32 may also include seal means or structure for maintaining the integrity of the outer casing so that no fluid/water escapes the outer casing before exiting through the outlet. Other features of the product structure 32 illustrated in FIG. 3 include mechanical actuators 48 operatively positioned thereon for defining the volume of fluid to be dispensed at any one cycle. Finally, the product structure 32 also includes a dispense volume indicator 50 which informs a user of the volume of flavored and/or enhanced fluid that is intended to be dispensed during a single cycle.

FIG. 4 illustrates another possible representative product structure according to the present disclosure. Specifically, the product structure 32 of FIG. 4 includes all the elements described above for FIG. 3 but utilizing alternate structures therefore. It should be understood that FIGS. 3 and 4 are representative of only two of a plurality of possible structural combinations that could be utilized by a person skilled in the art to enable fluid/water being inputted into the product structure from a fluid/water source, the product structure including a porous material interior thereof which then interacts with the fluid being transferred therethrough and then the resultant mixture from the transfer of the enhanced ingredients contained in the porous media to the liquid/water is transported to a remote dispensing location (see FIGS. 5-13) for utilization by a consumer.

One representative system 60 incorporating the liquid enhancing ingredient transferring mechanism 20 and the product structure 32 of the present disclosure is illustrated in FIG. 5 in the form of a kitchen faucet or side faucet. As illustrated, the liquid enhancing transferring mechanism is operatively positioned such that the incoming water supply is delivered to the inlet of the product structure 32, which is positioned inside the access structure 30. As illustrated, the specific device includes a dual flow spout for separating the filter water from the enhanced water and is controlled, presently preferably, by a single level dual action faucet handle, the operation of which would be understood by those skilled in the art.

FIG. 6 illustrates other possible systems for utilizing the liquid enhancing ingredient transferring mechanism 20 and the product structure 32 of the present disclosure. As is clearly discernible, the liquid enhancing transferring mechanism and the product structure are operatively incorporated into the bathroom faucet dispenser and could be utilized in the same manner as the kitchen faucet or the side faucet illustrated in FIG. 5, as would be understood by those skilled in the art.

Figure 7:
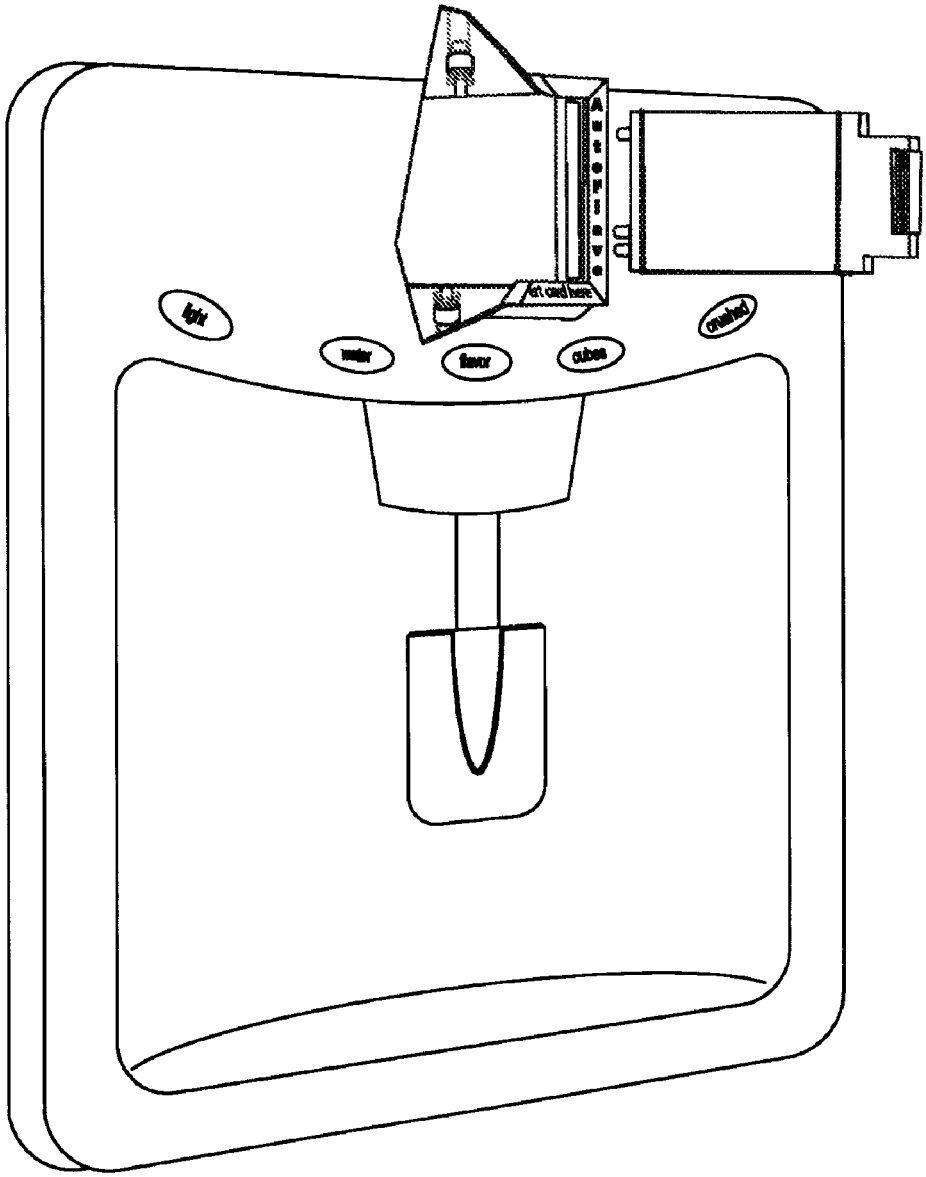
FIG. 7 is a perspective schematic view of another of the plurality of possible representative embodiments of a system for utilization of the liquid enhancing transferring mechanism according to the present disclosure.
Figure 8:
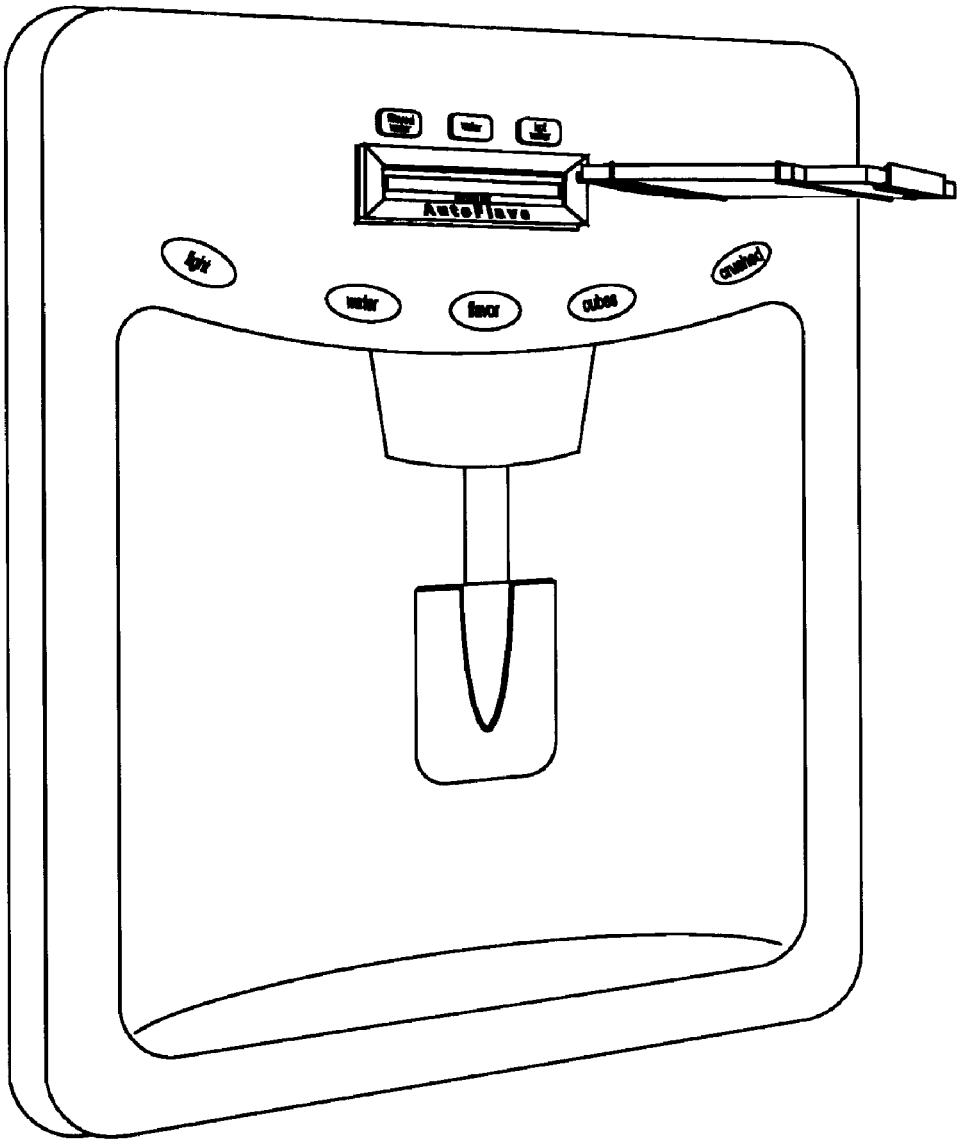
FIG. 8 is a perspective schematic view of an alternative embodiment of the system for utilization of the liquid enhancing transferring mechanism according to FIG. 7.
Figure 9:
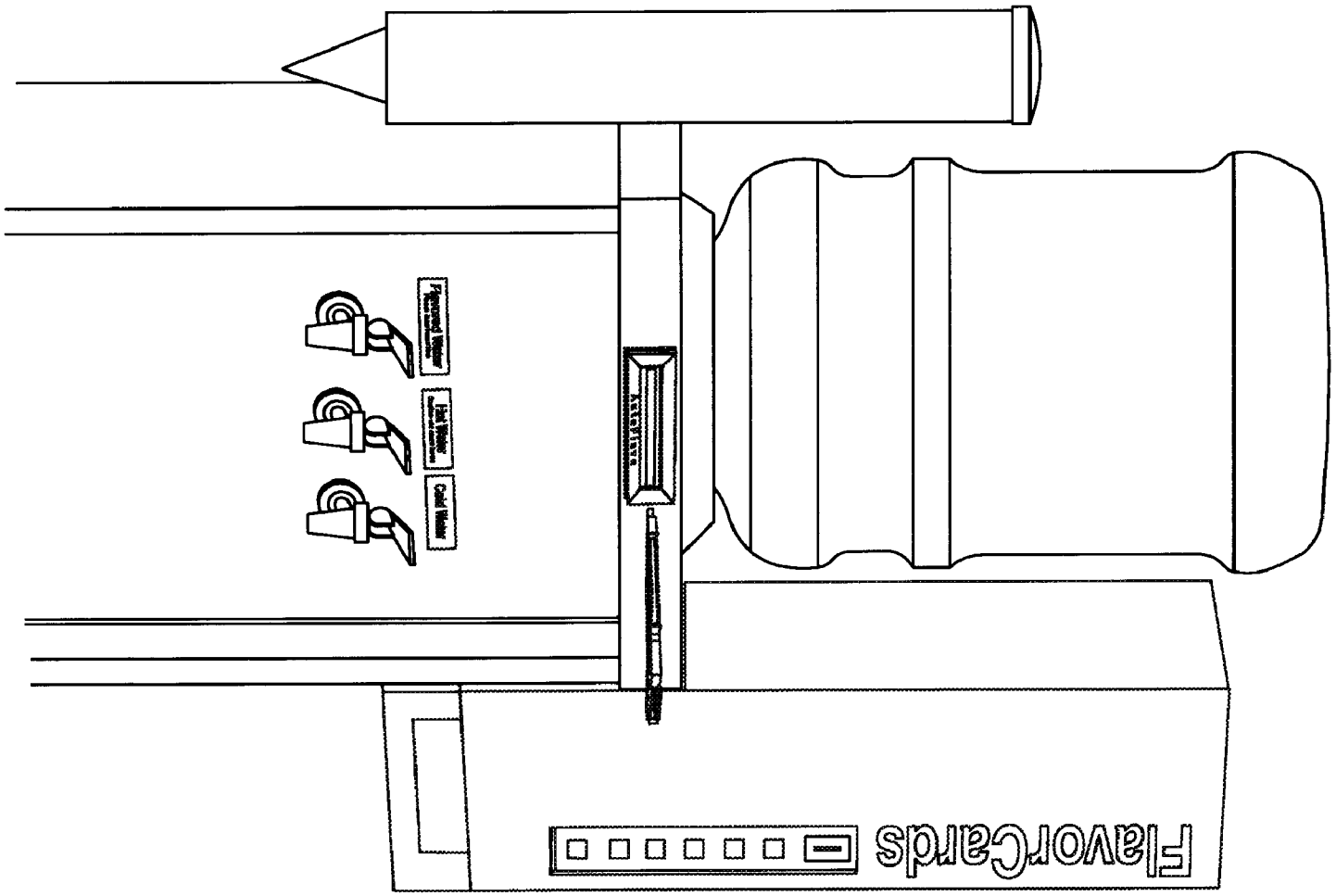
FIG. 9 is a perspective schematic view of another of the plurality of possible representative embodiments of a system for utilization of the liquid enhancing transferring mechanism according to the present disclosure.
Figure 10:
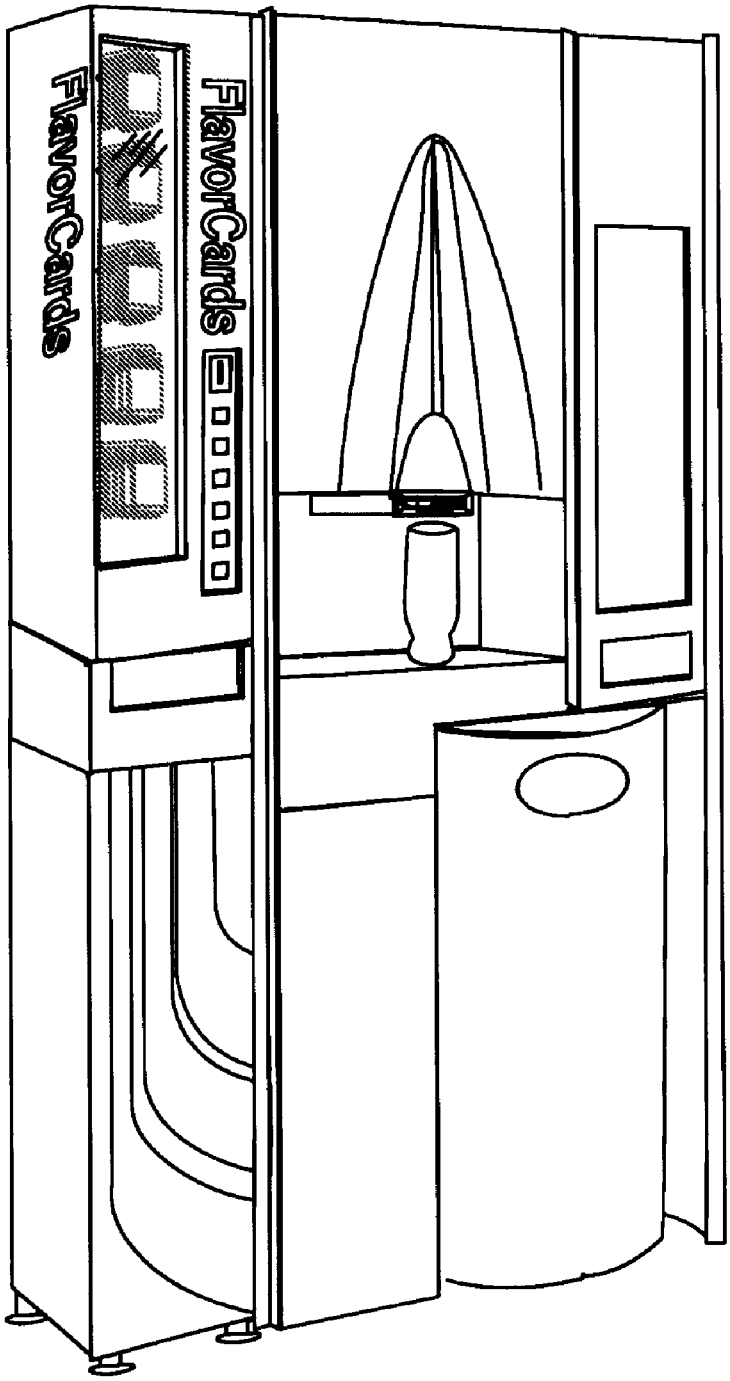
FIG. 10 is a perspective schematic view of another of the plurality of possible representative embodiments of a system for utilization of the liquid enhancing transferring mechanism according to the present disclosure.
Figure 11:
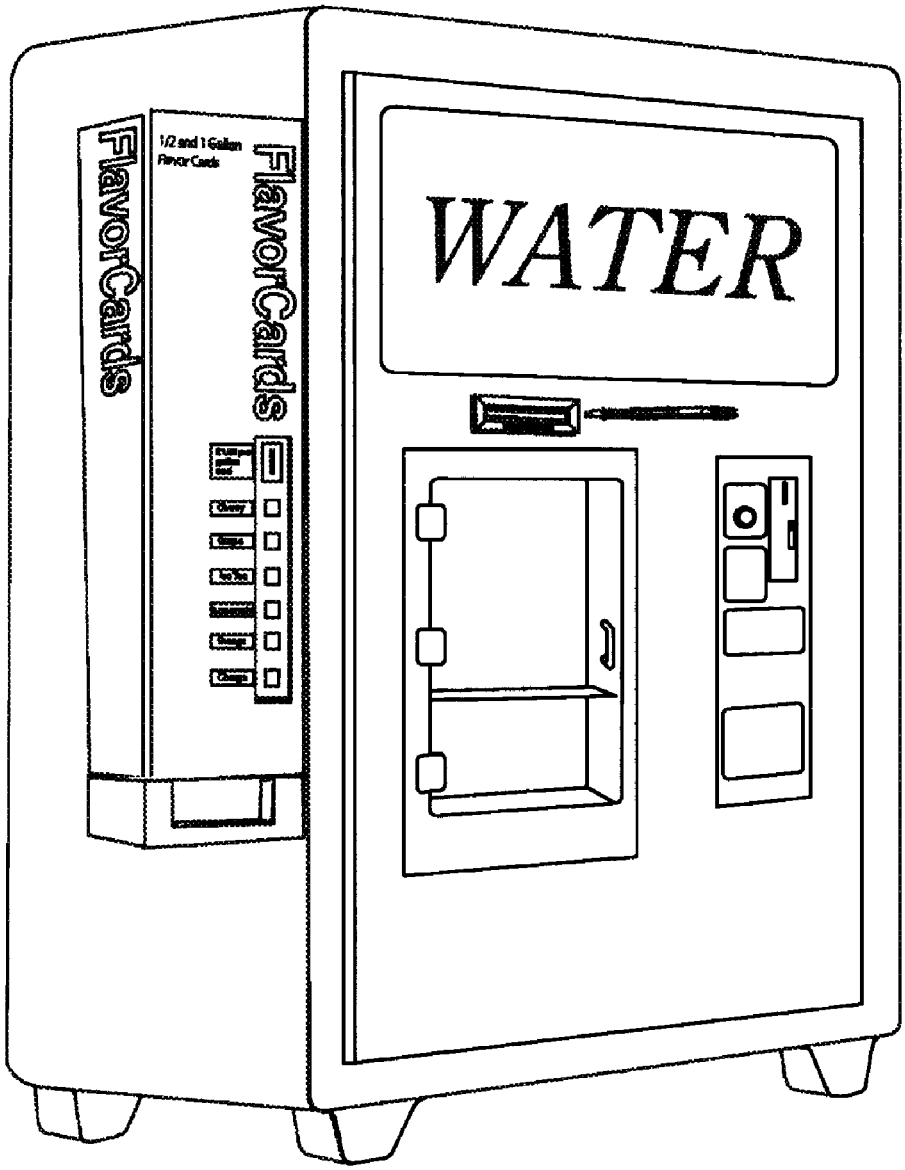
FIG. 11 is a perspective schematic view of another of the plurality of possible representative embodiments of a system for utilization of the liquid enhancing transferring mechanism according to the present disclosure.
Figure 12:
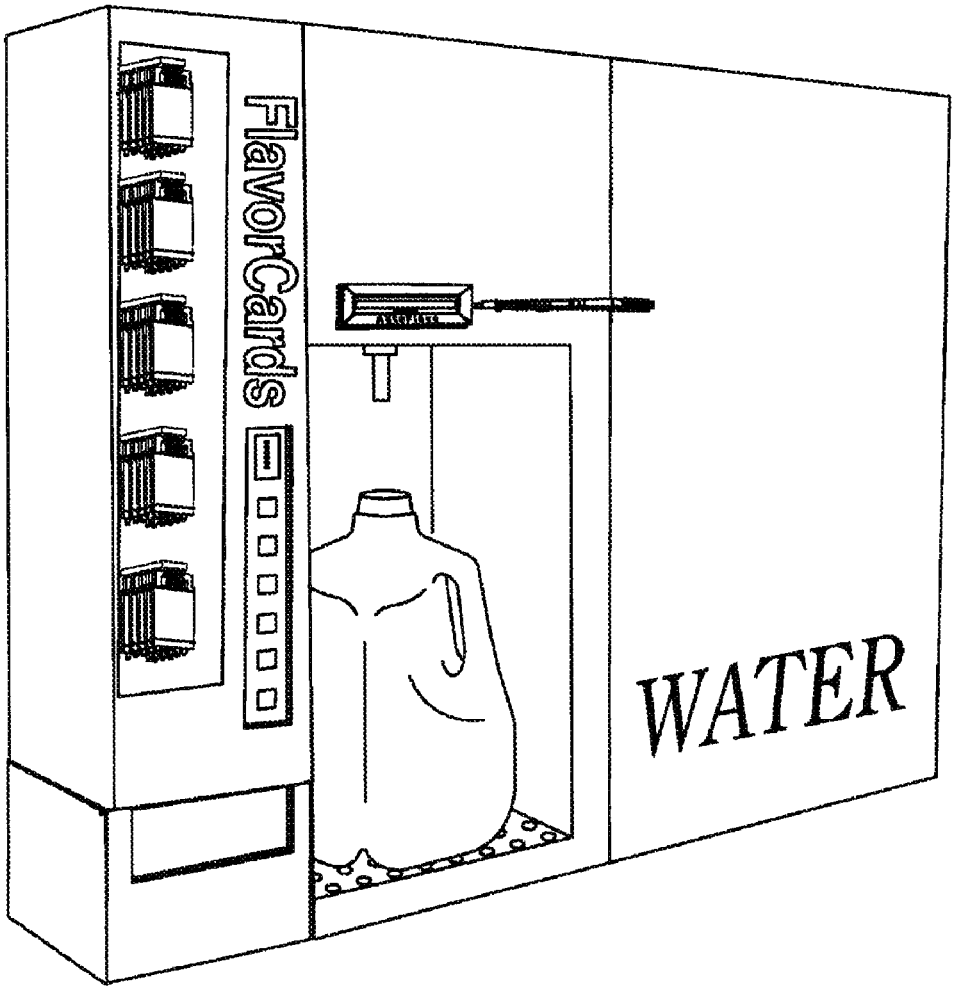
FIG. 12 is a perspective schematic view of another of the plurality of possible representative embodiments of a system for utilization of the liquid enhancing transferring mechanism according to the present disclosure.

FIGS. 7 and 8 illustrate possible representative systems for utilization in representative refrigerators. As illustrated, the liquid enhancing ingredient transferring mechanism 20 and the product structure 32 are operatively positioned in the refrigerator such that a consumer could insert the structure into the liquid dispensing mechanism for utilization of the liquid/water enhancing properties contained in the structure. Various control mechanisms such as control actuated buttons are operatively positioned on the refrigerator liquid and ice dispensing system, similar to various control systems being used to dispense filtered water, ice cubes and crushed ice, made from filtered water, as done in numerous current models of refrigerators. As illustrated, different dispensing points would be utilized by the enhanced/flavored water and the merely filtered water. In order to achieve this, a conventional bypass mechanism would be operatively attached internally such that the incoming filtered water supply would flow directly to the filtered water dispenser or be diverted into the liquid enhancing transferring mechanism 20, the output of which would be directed to the enhanced/flavored water dispenser, as would be a understood by those skilled in the art.

FIGS. 9-12 illustrate possible representative water cooler and/or vending machines embodiments incorporating the liquid enhancing ingredient transferring mechanism 20 and the product structure 32 or card of the present disclosure. The location and the execution of the details of the integration of these components into the larger liquid dispensing vessels are similar to those described and illustrated above and would be understood by those skilled in the art.

Figure 13:
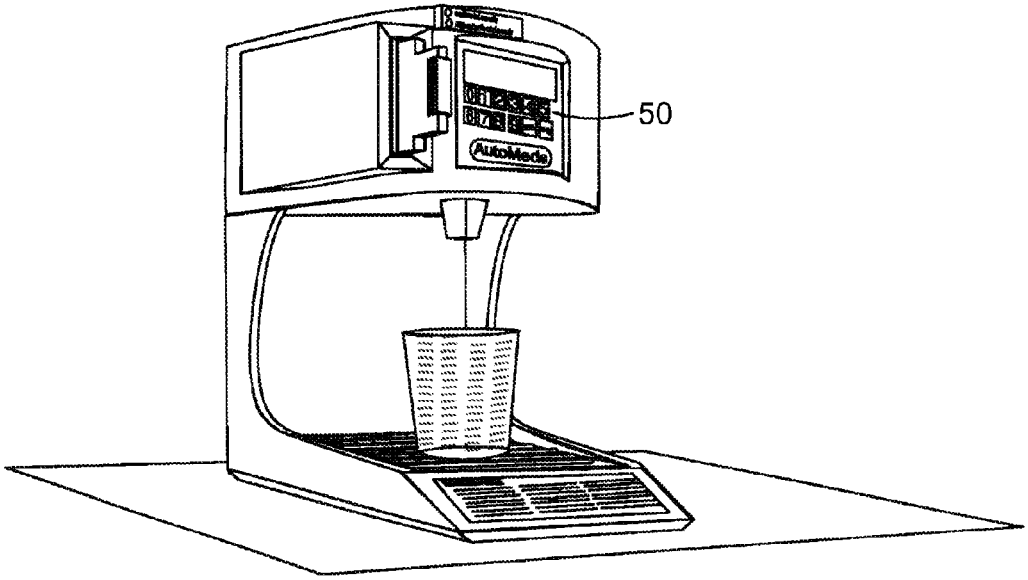
FIG. 13 is a perspective schematic view of yet another of the plurality of possible representative embodiments of a system for utilization of the liquid enhancing transferring mechanism according to the present disclosure.

FIG. 13 illustrates a possible representative system for in-room medication dispenser. This particular representative embodiment would fill the need to mask the taste of various normally solid medications and especially for liquid medication, which could be given to patients who are unable to swallow pills easily. In this particular representative embodiment, the liquid enhancing ingredient transferring mechanism 20 and the product structure 32 card of the present disclosure are incorporated into a medication dispensing system in a manner that various degrees of enhancement and/or intense flavored fluids are utilized to mask the medication being given to patients in hospitals or other institutions where medications are dispensed and administered. The structure and the operational controls for the liquid enhancing ingredient transferring mechanism 20 and the product structure 32 card are similar to those of the other devices illustrated in the present disclosure and the operation of such would be understood by those skilled in the art.

As can be seen from the above, applicant has provided comprehensive systems and methods for dispensing servings, individual and/or multiple, of flavored and enhanced water, more particularly to media(s) capable of introducing nutrients/flavors in single servings (4-12 oz) or multiple servings, such as, for example, a pitcher (up to 64+ oz), or a gallon or half gallon and/or pharmaceuticals in a single serving (1-2 oz) dose packet, the media(s) being operatively contained in appropriate means or structure such as, for example, packets/cards or similar devices as may be found to accomplish the desired function, operable with the dispensing systems and methods and most particularly to complimentary dispensing systems and methods operatively associated with or without a water filtration device for dispensing the individual servings (4-12 oz) or multiple servings, such as, for example, a pitcher (up to 64+ oz) or a gallon or half gallon of flavored and enhanced water and/or pharmaceuticals individual servings (1-2 oz) to consumers.

ACTUAL EXAMPLES

Figure 14:
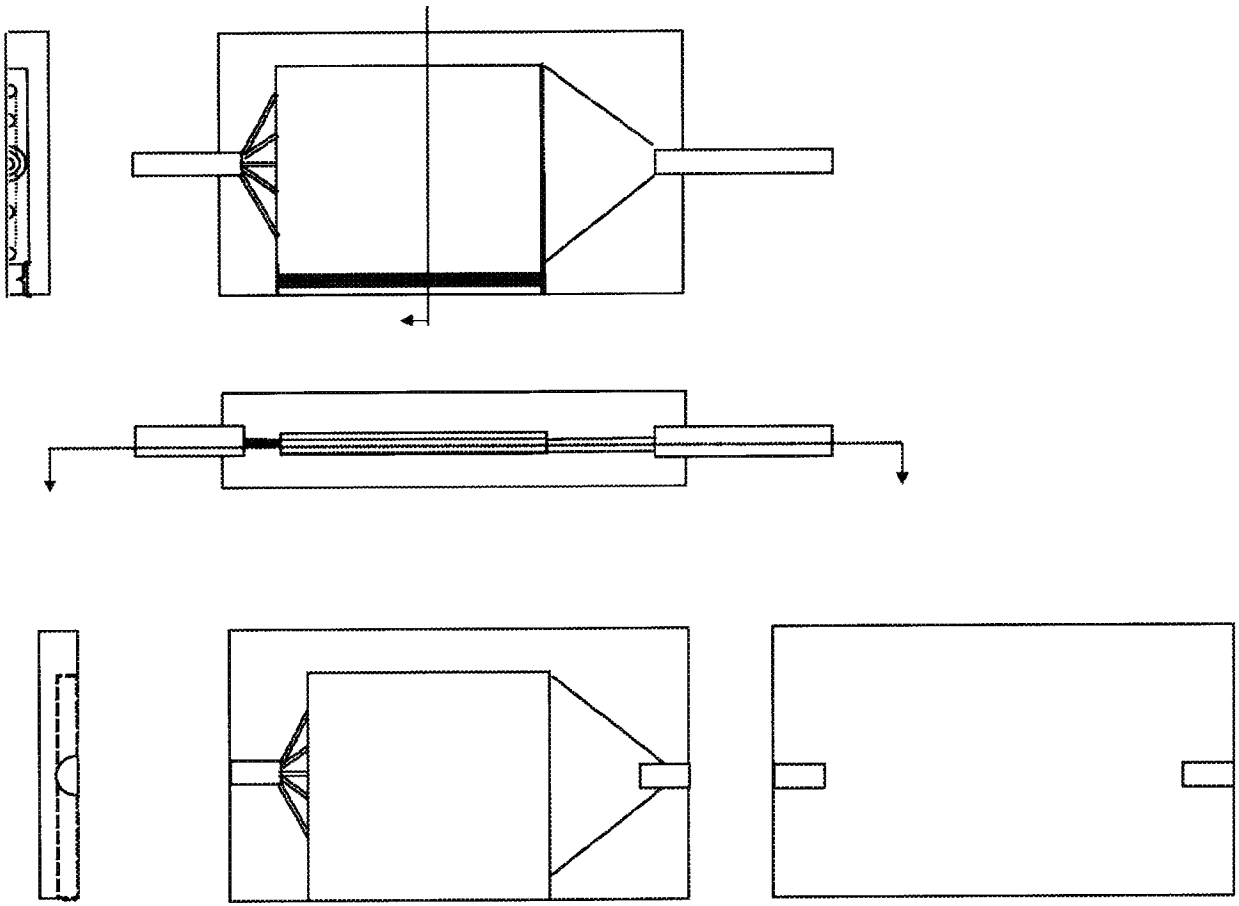
FIG. 14 is a diagrammatic illustration of the dispensing system used in the Actual Examples referred to in Paragraph [0105 ].

In demonstrating the potential and practicality of this invention, a dispensing system generally depicted in FIG. 14 and several structure variations were prepared.

The DISPENSER was machined out of two pieces of flat stock clear acrylic so that the flow of water could be seen as it passed through the media and ingredients. The two parts were glued together with ¼" tubing attached to each end in the direction of the intended flow. Veins were machined into the inlet side of the structure holder dispenser to distribute the flow across the width of the ingredient-laden structure. The opening for the structure was sized so that the structure could be inserted from the side. The opening was such that the structure fit tightly into the opening and was sealed with a piece of waterproof tape. Water was introduced from a reservoir suspended two feet in the air. A petcock was used to actuate the water flow. Gravity was the only driving force. The water flow was regulated with an orifice adjusted to allow approximately 0.5-0.6 gpm. The water flowed through the ingredient structure longitudinally exiting out the ¼" tube into drinking glasses.

The structures incorporating the ingredients were made up of highly porous polyester non-woven sheets cut to the size of a common credit card. The sheet material was approximately ⅛" thick. Several different techniques of saturating/infusing the cut sheets with ingredients were attempted.

a, Sweetened and unsweetened flavor structures. The sheet was first moistened with distilled water. Excess water was removed so that the pores were not filled with water droplets. A measured amount of dry ingredients equivalent to that prescribed for a 12-ounce serving was air blown into the moist structure. In some samples, the entire structure was attempted to be evenly coated and in others, a more concentrated amount was adhered to the outlet end of the structure. All versions were allowed to dry for a 24 our period and then wrapped in a foil packet for transportation. "Raspberry Crystal Lite" a product of Kraft foods currently on the market was one of the preformulated ingredients used. The attempt was to produce the same flavor and intensity (taste, aroma and color) from the direct flow dispenser as that produced per the manufactures specifications. Some of the samples were tightly wrapped in aluminum foil with just the two ends open to accept water flow others were removed from the foil completely allowing free flow across the entire surface of the structure. It was noted that different ingredients/formulas from different manufacturers dissolved at different rates. In most cases however the resultant dispensed liquid had adequate flavor, aroma and color to meet the expectations of the recipient, In some cases, without further fabrication to the ingredients, a significant amount of the ingredient was left undisclosed. In subsequent trials, it was proven that regrinding the ingredients into a finer powder improved their solubility.

b, Mineral and vitamin flavored Structures. Using the same process as above to moisten the sheet material coral calcium, vitamin C and dry lemon Kool-Aid were ground to a very fine powder, mixed and measured to equal a 6 ounce serving. Structures were prepared in the same manner as above both foil encased and fully exposed. Water with an average of 120 ppm hardness (as calcium carbonate) was prepared and dispensed through the media structure at the same flow rate as above. The more soluble Kool-Aid and vitamin C (in the form of citric acid) was mostly depleted from the structure with in the 6 ounce dispense while the less soluble coral calcium showed little sign of being dissolved. However, the effluent water did show an increase in calcium content.

c, Other attempts were made with a combination of ingredients and media structures the variations included thinner and thicker structures; those with single holes (baffles) within the structures and those with multiple baffles to induce turbulence. It was noted that an increase in turbulence while maintaining the same flow rate increase the solubility of all ingredients.

d, Other designs used larger spaces with in the structures to hold all the ingredients in a granular form. The ingredients were not adhered to the structure medium.

e, It was possible to form the structure media with the ingredients at the same time reference the Apollo process, as disclosed in commonly owned US Patent Publication No. US 2004/0168973 A1, Published Sep. 2, 2004, the disclosure of which is herein incorporated by reference to the extent not inconsistent with the present disclosure. This process is a completely dry process wherein the ingredients are entrapped within a porous matrix. Since extremely fine micro powders are used, it was not surprising to see the highest level of solubility, as thin sheets can be made having a unique structure, which can hold soluble ingredients allowing them to dissolve and still hold its structure. However, any food grade card stock could be used as well.

Although the systems and methods of the subject disclosure have been described with respect to presently preferred embodiments, those skilled in the art will readily appreciate that changes and modifications which may be made thereto without departing from the spirit and scope of the present disclosure.

What is claimed is:

1. A system for transferring sufficient amounts of any one of a plurality of selected ingredients to a liquid comprising:

a product structure including a porous media element and a card shaped outer casing, wherein the porous media element defines a front major surface and an opposing back major surface and the outer casing encases the porous media element over the front major surface and the opposing back major surface, and wherein the porous media element is impregnated with sufficiently controlled amounts of any one of the plurality of selected ingredients therein for controlled release upon sufficient contact with a liquid to form a mixture; and a liquid enhancing transfer mechanism, operative to house the product structure, to facilitate flow of the liquid to the product structure and to transfer the resultant mixture from the transfer mechanism to a remote location.

2. The system of claim 1, wherein the selected ingredients are selected from the group comprising:

liquid flavoring, vitamins, minerals, medicine, and mixtures thereof.

3. The system of claim 1, wherein the liquid enhancing transfer mechanism further comprises:

at least one fill control device;

at least one product structure housing configured for receiving incoming liquid/water, delivering flavored water to a remote location, and operatively receiving and housing the product structure.

4. The system of claim 1, wherein the product structure is about the size of a credit card.

5. The system of claim 1, wherein the liquid enhancing transfer mechanism further comprises:

water receiving structure for receiving an incoming water supply;

structure, operatively connected to the water receiving structure, for moving the water operatively through the liquid enhancing transfer mechanism such that the enhancing ingredients contained in the product structure are substantially transferred to the water; and transmitting structure, operatively connected to the water moving structure, for transmitting the enhanced water to a remote location where the outpouring of carbonated or non-carbonated flavored liquid is received by an end user.

6. The system of claim 1, wherein the liquid enhancing transfer mechanism further comprises:

an access structure for receiving and housing the product structure, the product structure being readily insertable into and removable therefrom.

7. The system of claim 6, wherein the access structure is selected from the group comprising:

a slot, an access panel, a door cover, or other equivalent structure.

8. The system of claim 1, wherein the product structure is configured to sufficiently perform a desired liquid enhancement function.

9. The system of claim 1, wherein the porous media element has a thickness of about ⅛ inch to about ¼ inch.

10. The system of claim 1, wherein the porous media element is impregnated with a flavored ingredient and a nutraceutical ingredient.

11. The system of claim 1, wherein the liquid enhancing transfer mechanism includes an internal inlet pathway from a water inlet and an internal outlet pathway fluidly connected to an exit port at the remote location, and further wherein the system is configured such that upon assembly of the product structure within the liquid transfer mechanism, a product structure outlet is fluidly connected to the internal outlet pathway for directing the resultant mixture from the outlet, through the internal outlet pathway and to the remote location exit port.

12. The system of claim 1, wherein the outer casing is comprised of porous hydrophobic material.

13. The system of claim 1, wherein the product structure includes an inlet and an outlet, the inlet and outlet both positioned on a first end of the outer casing.

* * * * *